United States Patent [19]

Brocklebank et al.

[11] Patent Number: 4,859,138

[45] Date of Patent: Aug. 22, 1989

[54] BOOM FOR A VEHICLE INCLUDING FOLDING LINKAGE BETWEEN BOOM PARTS

[75] Inventors: Norman Brocklebank, New Walk; Alan Cooper, Common Lane, both of United Kingdom

[73] Assignee: J.C. Bamford Excavators Limited, Rocester, United Kingdom

[21] Appl. No.: 197,502

[22] PCT Filed: Sep. 24, 1987

[86] PCT No.: PCT/GB87/00676

§ 371 Date: May 23, 1988

§ 102(e) Date: May 23, 1988

[87] PCT Pub. No.: WO88/02420

PCT Pub. Date: Apr. 7, 1988

[30] Foreign Application Priority Data

Sep. 27, 1986 [GB] United Kingdom ..... 8623313

[51] Int. Cl.[4] ..... E02F 3/38

[52] U.S. Cl. ..... 414/694; 414/695.5; 74/105; 74/108

[58] Field of Search ..... 414/685, 694, 695.6; 74/105, 108, 99 R

[56] References Cited

U.S. PATENT DOCUMENTS

| | | | |
|---|---|---|---|
| 2,841,998 | 7/1958 | Troche | 74/108 |
| 3,259,259 | 7/1966 | Metailler | 414/694 |
| 3,380,604 | 4/1968 | Leese | 414/694 |
| 3,904,051 | 9/1975 | Tsuchiya . | |
| 3,952,890 | 4/1976 | Armstrong | 414/694 |

FOREIGN PATENT DOCUMENTS

| | | | |
|---|---|---|---|
| 0184386 | 6/1986 | European Pat. Off. . | |
| 1634928 | 7/1970 | Fed. Rep. of Germany . | |
| 1395675 | 3/1964 | France | 414/694 |
| 1447711 | 9/1965 | France | 414/694 |
| 1454144 | 9/1966 | France . | |
| 2202988 | 5/1974 | France . | |
| 2365008 | 4/1978 | France . | |
| 8704201 | 7/1987 | PCT Int'l Appl. . | |
| 196213 | 5/1965 | Sweden | 414/694 |

*Primary Examiner*—Robert J. Spar
*Assistant Examiner*—William M. Hienz
*Attorney, Agent, or Firm*—Robert C. Baker

[57] ABSTRACT

A boom H for a vehicle A which carries a working implement K to enable operations to be carried out such as excavation or loading, comprises first (11) and second (10) parts, the first part (11) carrying the working implement (K) and the second part (14) being mounted on a body (B) of the vehicle, the first and second parts being connected together for relative pivotal movement about a generally horizontal axis (A 1), a fluid operated actuating means (18) acting between the first (11) and second (10) boom parts to effect relative pivotal movement at least in one sense of rotation, characterized in that the fluid operated actuating means (18) comprises two relatively movable members (20,23) which operate in tension, one member (20) being pivotally secured to one of the boom parts (14) and the other member (23) being connected via a flexible linkage (24) to the other boom part (11) to enable the two boom parts to be relatively pivoted to include a smaller angle between them than would be possible with a rigid linkage with an actuating means (18) operating in tension.

22 Claims, 5 Drawing Sheets

BOOM FOR A VEHICLE INCLUDING FOLDING LINKAGE BETWEEN BOOM PARTS

DESCRIPTION OF THE INVENTION

This invention relates to a boom for a vehicle and more particularly to a boom for carrying a working implement to enable operations to be carried out such as for examples only, excavation or loading.

According to a first aspect of the invention we provide a boom for a vehicle, the boom comprising first and second parts, the first part carrying a working implement and the second part being mounted on a body of the vehicle, the first and second parts being connected together for relative pivotal movement about a generally horizontal axis, a fluid operated actuating means acting between the first and second boom parts to effect the relative pivotal movement at least in one sense of rotation, characterised in that the fluid operated actuating means comprises two relatively movable members which operate in tension, one member being pivotally secured to one of the boom parts and the other member being connected via a flexible linkage to the other boom part.

Thus the two boom parts can be relatively pivoted to include a smaller angle between them than would be possible with a rigid linkage with the actuating means operating tension.

For example, the first boom part may comprise a dipper arm of an excavating vehicle which carries a bucket at its end outermost from the vehicle body. The included angle between the dipper and the second boom part can be reduced compared with rigid arrangements, to facilitate operation of the bucket over a larger working range.

The invention is particularly applicable where the boom is long i.e. more than seven metres long. Previously it has been necessary to use a cable and winch arrangement to cause the pivotal movement between the two boom parts, where it is required to permit the boom parts to pivot relative to one another to obtain an included angle of less than about 40° and either a cable arrangement is required to move the boom parts outwardly from such an included angle, or to use a fluid operated actuated means operating in compression.

An arrangement which uses a cable arrangement to effect movement of one boom part relative to the other in both senses of rotation is shown and described in EP specification No. 0077684 of Priestman.

A ram between two such boom parts to effect movement of the boom parts in one sense of rotation only, but which does not operate in tension, but rather in compression, is shown and described in our previous Application No. GB 2168320. A winch and cable arrangement is used to effect relative movement in the other sense of rotation.

The flexible linkage arrangement of the boom may comprise one rigid element pivotally connected at or adjacent one end to the respective member of the fluid operated power means, and the rigid element may be pivotally connected at or adjacent its other end to the other boom part.

Alternatively, the flexible linkage may comprise two or more rigid elements which are pivotally interconnected to each other, one of the elements being pivotally connected at or adjacent one end to the respective member of the fluid operated actuating means and the other, or one of the other rigid elements may be pivotally connected at or adjacent one end to the other boom part.

Where two rigid elements are provided, preferably one is longer than the other.

In each case, the flexible linkage may be connected at or adjacent one end to a mounting point of the other boom part and at or adjacent the other end to one of the relatively movable members of the actuating means, and the other of the relatively movable members of the actuating means may be pivotally mounted to a mounting point of the second boom part. Preferably the actuating means is positioned exteriorly of the boom parts, the mounting points being spaced outwardly of the adjacent regions of the boom parts.

The rigid element or elements may be pivotable relative to the other boom part around the pivot axis between the two boom parts at least as the actuating means permits the two boom parts to relatively pivot to reduce the included angle between them, beyond a threshold angle.

For example, a pulley surface or other guide means may be provided, which moves about the pivot axis as the boom parts relatively pivot, and the flexible linkage may engage the guide means as the boom parts are pivoted beyond the threshold angle.

The or one of the rigid elements of the flexible linkage may be configured to the shape of the guide means to facilitate this engagement with the guide means.

The geometry of the boom may be arranged so that when the second boom part is generally horizontal, the actuating means and at least the mounting point of the second boom part are above a generally horizontal plane containing the horizontal axis of pivot between the two boom parts.

Auxiliary means such as winch and cable arrangement may be operable to effect relative pivotal movement of the two boom parts to reduce the included angle between them, the fluid operated actuating means being operative only to effect relative pivotal movement in the other sense of rotation to enable the included angle between the two boom parts to increase.

According to a second aspect of the invention we provide a vehicle having a vehicle body on which is mounted a boom in accordance with the first aspect of the invention. Preferably the mounting between the second boom part and the vehicle body permits the second boom part to pivot relative to the vehicle body, and the pivotal movement may be effected by a power means such as a fluid operated ram.

A working implement may be pivotally mounted on the first boom part and power means, such as a further ram may act between the first boom part and the implement, to effect pivotal movement of the implement relative to the first boom part.

The invention will now be described with the aid of the accompaning drawings in which.

Figure 1:
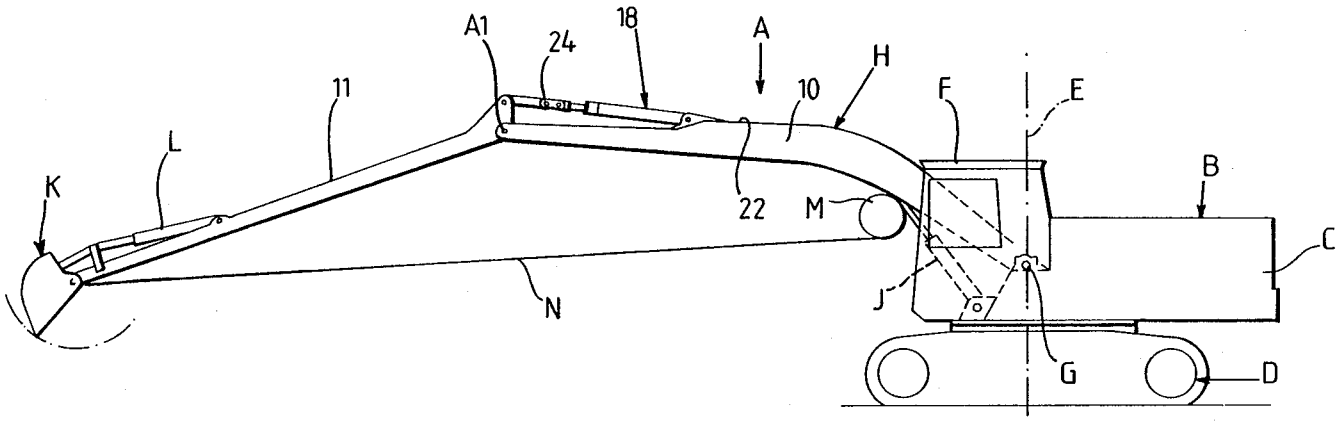
FIG. 1 is a side illustrative view of a vehicle incorporating the invention.

Referring first to FIG. 1, an excavating or earth moving vehicle is shown a A which includes a body B including a base frame C mounted on a ground-engaging propulsion means D, for slewing movement about a vertical axis E, the base frame C including an operator's cab F and a mounting G for mounting a boom H on the base frame C for pivotal movement relative thereto.

Figure 2:
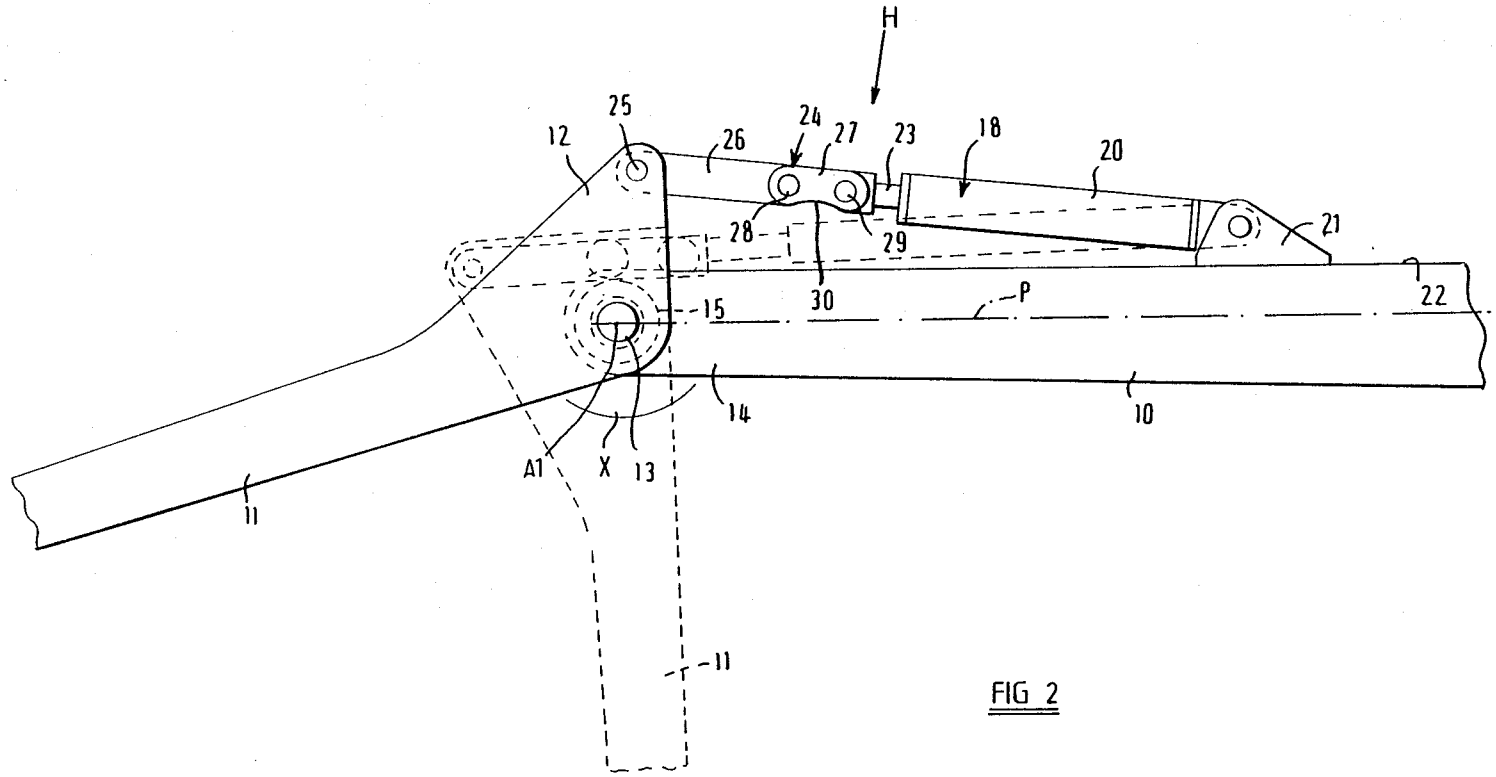
FIG. 2 is an illustrative view of a first embodiment of a boom in accordance with the invention showing two boom parts in two alternative configurations.

The boom H is movable upwardly and downwardly from the full line position shown in FIG. 1 to the position indicated by the dotted lines in FIG. 2, by means of fluid operated power means comprising a pair of hydraulic rams J, only one of which can be seen in FIG. 1.

The boom H is a two part boom, a main boom part 10 extending from the body B and being pivotally connected to a further boom part or dipper arm 11 which moves relative to the boom part 10 about a generally horizontal axis A1.

At the outer end of the dipper arm 11 a working implement comprising in this example, an excavating bucket K is provided, which bucket K is pivotable relative to the dipper arm 11 by a further fluid operated power means such as hydraulic ram L.

Instead of the working implement comprising an excavating bucket, the working implement could comprise a loader bucket, loading forks, a shovel, or any other working implement as required.

A winch M is mounted on the main boom part 10 but alternatively could be mounted on the body B, and a cable N extends from the winch to a mounting point adjacent the bucket K. A hydraulic actuating means 18 is pivotally mounted on the boom part 10 and is connected via a flexible linkage 24 to the dipper arm 11.

The winch M and cable N are used to effect inward movement of the bucket K relative to the body B, and the actuating means 18 is used to effect outward movement of the bucket K relative to the body B. It will be appreciated that actuating means 18 operates in tension because the actuating means is mounted on a top surface 22 of the main boom part 10 and the dipper 11 depends from the main boom part 10.

A more detailed description of a vehicle of this type is given in our copending British application which was published on the 18th June 1986 under No. GB 2168320. In this earlier specification however, an actuating means corresponding to actuate means 18, operates in compression rather than tension is described with reference to FIG. 1 hereof.

Referring now to FIG. 2, part of the boom H is shown in more detail.

As mentioned above, the dipper 11 and main boom pat 10 are pivotally secured together for relative pivotal movement about the generally horizontal axis A1. to facilitate this, end 12 of the dipper 11 adjacent the axis A1, comprises a bifurcated part, and the pivot is provided by a pivot pin 13 which passes through each fork of the bifurcated part, and through the end 14 of the main boom part 10.

Mounted about the pivot pin 13 between the forks of the bifurcated part at the end 12 of the dipper 11, is a furrule or pulley surface 15, the purpose of which will become apparent hereinafter.

The hydraulic actuating means 18 which is provided to effect pivotal movement of the dipper 11 relative to the boom part 10, comprises a hydraulic ram, a cylinder 20 of which is pivotally secured to a mounting point 21 on a top surface 22 of the main boom part 10.

A rod 23 of a piston of the ram 18 is connected to the flexible linkage 24 which in turn is connected to a mounting point 25, again provided by a pivot pin extending between the forks of the bifurcated part at the end 12 of the dipper 11.

As shown in full lines, the boom part 10 is generally horizontal, and the actuating means 18 and mounting point 25 are entirely above a generally horizontal plane P containing the horizontal axis A1 of pivot between the boom part 10 and dipper 11. Thus there is an included angle X between the dipper 11 and the boom part 10.

By operating the winch M, the dipper 11 can be pivoted relative to the main boom part 10, provided that the hydraulic circuit in which the ram 18 is provided, permits the piston 23 to move outwardly of the cylinder 20 of the ram 18. Hence the included angle X between the dipper 11 and boom part 10 can be reduced. When the dipper 11 reaches the position shown in dotted lines in FIG. 2, the flexible linkage 24 will bear on the pulley surface 15 of the ferrule mounted around the pivot pin 13. If the linkage 24 were rigid, further movement of the dipper 11 beyond this position to reduce the included angle X still further, would not be permitted.

However because the linkage 24 is flexible, further movement is permitted.

Figure 3:
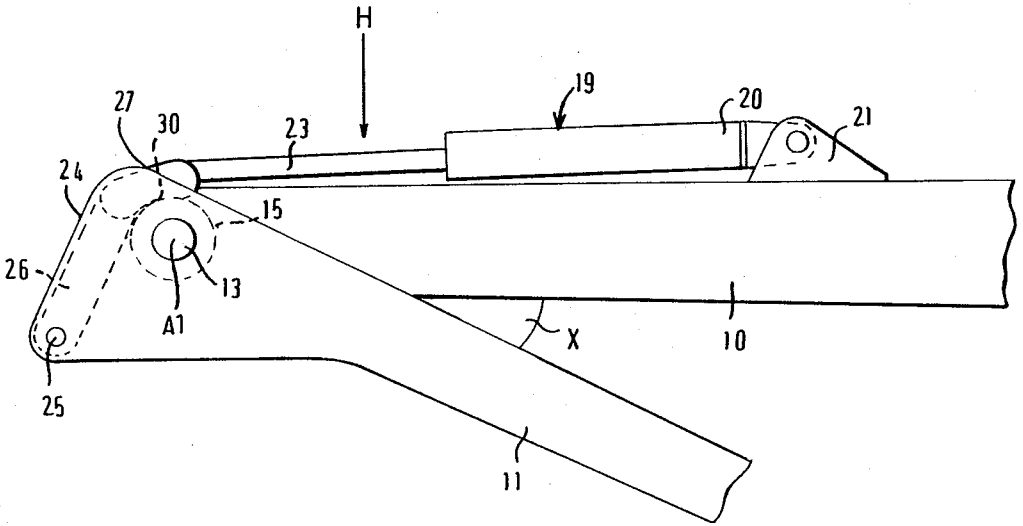
FIG. 3 is a further view of the boom of FIG. 2 but showing the two boom parts in a further configuration.

The linkage 24 of FIGS. 2 and 3 comprises two rigid elements 26 and 27, pivotally connected together for relative pivotal movement about a pivot 28. Element 26 is pivotally secured to the pivot of the mounting point 25 at the end 12 of the dipper 11, whilst element 27 is pivotally connected at pivot 29 to the rod of piston 23 of the hydraulic ram 18.

It can be seen that there is a cut away part 30 in a lower surface of the element 27 for a reason which will become apparent hereinafter.

Referring now to FIG. 3, it can be seen that as the dipper 11 moves relative to the boom part 10 beyond the position shown in dotted lines in FIG. 2, the elements 26 and 27 of the linkage 24 will relatively pivot to permit the linkage 24 to fold around and upon the pulley surface 15 of the ferrule around pivot pin 13, to permit included angle X between the dipper 11 and the boom part 10 to be reduced still further. The linkage 24 will also fold around horizontal axis A1.

Further, the cut away portion 30 of element 27, being of a similar radius to the pulley surface 15, enables the element 27 to lie close to the pulley surface 15 so that any load is evenly distributed around the ferrule.

The ferrule is free to rotate reduce friction between the linkage 24 and the pulley surface 15 as the linkage moves.

To move the dipper 11 outwardly to increase the included angle X between the dipper 11 and the boom part 10, the winch M is disengaged to permit such movement, and the hydraulic circuit to ram 18 is operated so as to retract the piston 23 inwardly of the cylinder 20.

The effort required to move the dipper 11 initially from the position shown in FIG. 3 increases as the dipper 11 moves to the position shown in dotted lines in FIG. 2.

It will be appreciated that in moving dipper 11 from the position shown in FIG. 3 to the dotted line position of FIG. 2, very little inward movement of the piston 23 relative to the cylinder 20 will be required. However, when a greater force is required i.e. when it is desired to move the dipper 11 outwardly from the position shown in dotted line FIG. 2, greater movement of piston 23 relative to the cylinder 20 will be required. Thus there is most efficient use of the ram 18 without requiring an unduly long stroke.

Various modifications may be made to the boom described without departing from the scope of the invention. For example, although as shown, the flexible linkage 24 comprises a first shorter element 27 and a second longer element 26, any other flexible linkage 24 which permits the movement of the dipper 11 relative to the boom 10 a required amount, by folding for example around the ferrule, pulley or other guide surface 15 around the pivot pin 13, could be used. Further, instead of the flexible linkage 24 being secured to the mounting point 25 at one end 12 of the dipper 11, if desired, the ram 18 could be secured to the dipper 11, and the flexible linkage 24 to the boom 10, although the arrangement described is preferred.

Any described number of links, similar to links 26, 27 may provide the flexible linkage 24 rather than just the two links shown.

Instead of a hydraulic ram 18, any other fluid operated power means or indeed any other actuator which comprises two relatively movable, preferably telescopic, parts could be used.

The invention is particularly applicable to booms for long reach machines as shown in FIG. 1 in which the boom H overall is longer than seven metres, although the invention could be applied to shorter booms if required.

As shown, the actuating means 18 is mounted exteriorly of the dipper 11 and boom part 10, but if desired, for another boom configuration, the actuating means 18 could be mounted interiorly of one or both of the boom parts 10 and 11.

Figure 4:
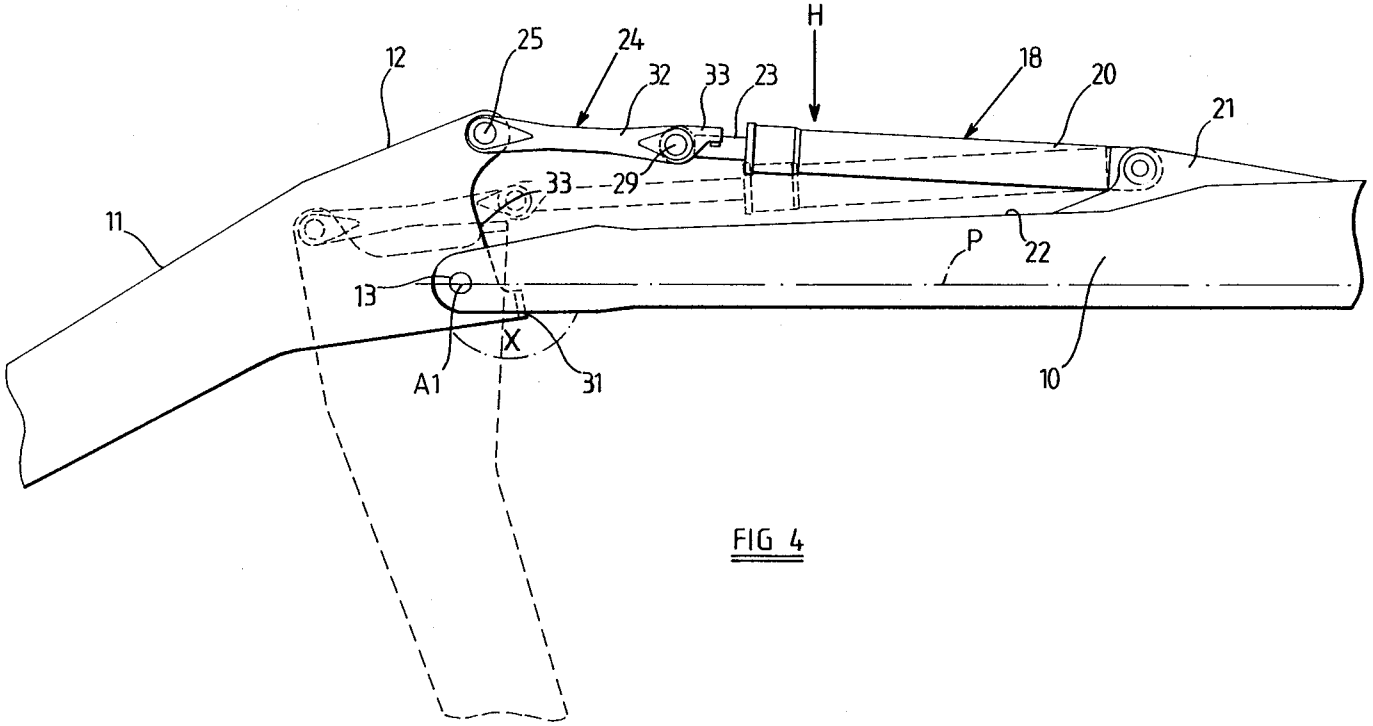
FIG. 4 is an illustrative view of a second embodiment of a boom in accordance with the invention, showing two boom parts in two alternative configurations, and, FIG. 5 is a further view of the boom of FIG. 3, but showing the two boom parts in a further configuration.
Figure 5:
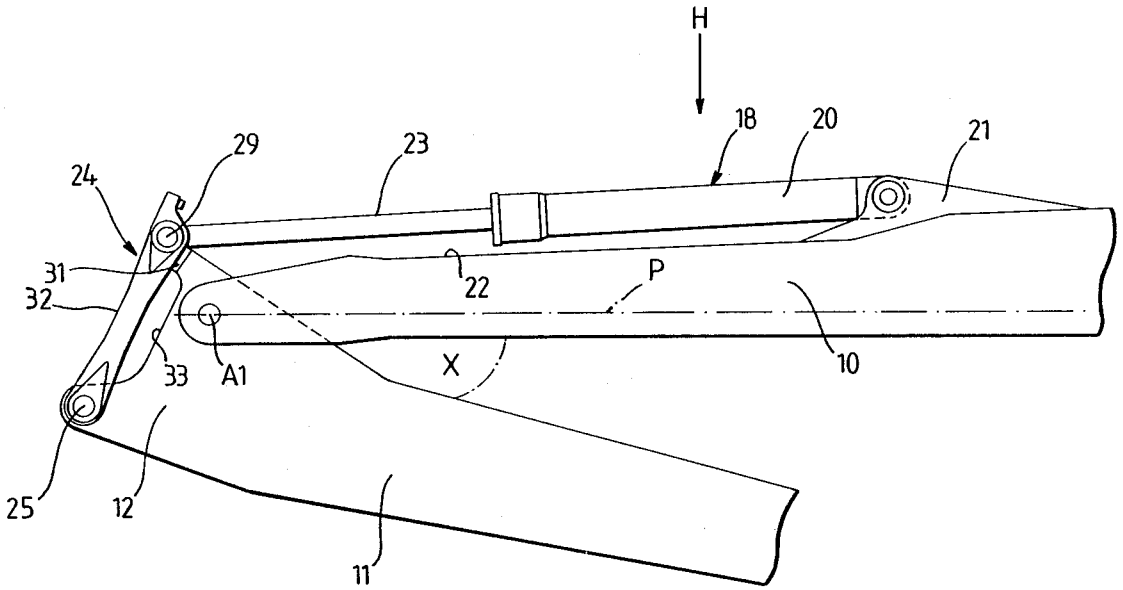

Referring now to FIGS. 4 and 5, a second embodiment of the invention is illustrated. Parts similar to parts of the boom H of FIGS. 2 and 3 are labelled with the same reference numerals and many of the possible mentioned modifications of the boom H of the FIGS. 2 and 3 version are possible modifications to the arrangement shown in FIGS. 4 and 5.

In FIG. 4, the boom H is shown in a generally horizontal position with the dipper 11 fully extended relative to the main boom part 10.

Like the FIG. 2 and 3 arrangement, movement of the dipper 11 to this position is achieved by a hydraulic ram 18.

The end 12 of the dipper is again bifurcated to facilitate mounting the dipper 11 on the main boom part 10 for pivotable movement about an axis A1. However there is no ferrule or pulley surface around the pivot pin 13 at the axis A1 as in FIGS. 2 and 3 embodiment, but a guide means to engage with the linkage 24 is provided by an abutment 31 located between the forks of the bifurcated end 12. That is, the element 32 is movable to fold upon abutment 31.

The main difference between the boom H of FIGS. 2 and 3 and the boom H of FIGS. 4 and 5 lies however in the nature of the linkage 24.

In FIGS. 4 and 5, the flexible linkage comprises a single rigid element 32 only, one end 33 of the element 32 being pivoted at 29 to the rod 23 of the piston of the ram 18, whilst the opposite end of the element 32 is pivoted to the end 12 of dipper 11 at 25.

The end 12 of the dipper 11 includes a cut away region 33 between the pivot 25 and the abutment 31 of the guide means.

Like the boom H of FIGS. 2 and 3, when the boom H is in the horizontal position, the actuating means 18 and the mounting point 25 are entirely above a generally horizontal plane P containing the axis A1.

As the dipper 11 is pivoted to the dotted line position of FIG. 4, the pivot 29, or at least that part of the element 32 around the pivot 29, will engage, that is, be folded upon the abutment 31 so that upon any further pivoting of the dipper 11 to reduce the included angle X between the dipper 11 and the main boom part 10 (which movement is achieved using the winch M) the element 32 will pivot about pivot 29 as shown in FIG. 5 so that the linkage 24 folds around the axis A1.

As mentioned in relation to the FIGS. 2 and 3 version, when pivoting the dipper 11 outwardly to increase angle X using the ram 18, as a greater force is required to move the dipper 11 outwardly from the dotted line position of FIG. 4 to the horizontal position shown in full lines, greater movement of the piston rod 23 relative to the cylinder 20 of actuator 18 will be required so that efficient use is made of the ram 18 over its entire stroke.

It will be appreciated that in FIGS. 2 and 4, the dotted line position shown represents a threshold position and further movement of the dipper 11 to reduce the included angle X from the position shown by dotted lines will require folding of the linkage 24 as described.

In each case, the invention is applied to an arrangement in which the actuating means 18 operates in tension, rather than compression.

The features disclosed in the foregoing description, in the following claims, or the accompanying drawings, expressed in their specific forms or in terms of a means for performing the disclosed function, or a method or process for attaining the disclosed result, may, separately or in any combination of such features, be utilised for realising the invention in diverse forms thereof.

We claim:

1. A boom for a vehicle, the boom comprising first and second parts,the first part carrying means for mounting an earth working implement and the second part having means for mounting the boom on a body of the vehicle, the first and second parts being connected together by pivot means which permit relative pivotal movement between the first boom part and the second boom part about a generally horizontal axis, an elongate actuating means mounted between the first and second boom parts and being operable to effect the relative pivotal movement between the boom parts in one sense of rotation only to increase an included angle between the first and second boom parts, auxiliary means being provided to effect relative movement between the boom parts to reduce the included angle between the boom parts, the elongate actuating means comprising two relatively movable fluid operated members which operate in tension and an extension linkage pivotally connected to one of said fluid operated members to form an elongate extension therefrom, said elongate actuating means being mounted solely at or adjacent its ends to said boom parts, one said end mounting of said elongate actuating means being pivotally connected via one of said fluid operated members to one said boom part and the other said end mounting of said elongate actuating means being pivotally connected via an end portion of said extension linkage to the other said boom part, said extension linkage being movable to fold upon a support structure at least in part carried by the other said boom part when said included angle is at a minimum, said pivot connection of said extension linkage to said one of said fluid operated members being free to move towards and away from the pivot means between said first and second boom parts. movable to fold upon.

2. A boom according to claim 1 which is more than seven meters long.

3. A boom according to claim 1 in which the extension linkage consists essentially of one rigid element.

4. A boom according to claim 1 wherein the extension linkage comprises two or more rigid elements which are pivotally interconnected to each other, one of said rigid elements being longer than any other.

5. A boom according to claim 1 wherein the elongate actuating means is positioned exteriorly of the boom parts, the mounting points being spaced outwardly of the adjacent regions of the boom parts.

6. A boom according to claim 5 wherein the extension linkage folds around the pivot axis between the two boom parts at least as the auxiliary means causes the two boom parts relatively to pivot to reduce the included angle between them beyond a threshold angle.

7. A boom according to claim 5 wherein said support structure is on the other said boom part and includes a guide means which moves about the pivot axis between the boom parts as the boom parts relatively pivot, the extension linkage engaging the guide means as the boom parts are pivoted toward a minimum included angle beyond the threshold angle.

8. A boom according to claim 1 wherein the geometry of the boom is arranged so that when the second boom part is generally horizontal, the elongate actuating means and at least the end mounting thereof to the first boom part are above a generally horizontal plane containing the horizontal axis of pivot between the two boom parts.

9. A boom according to claim 1 wherein the auxiliary means comprises a winch and cable arrangement.

10. A vehicle having a vehicle body on which is mounted a boom in accordance with claim 1.

11. A vehicle according to claim 10 wherein the mounting between the second boom part and the vehicle body permits the second boom part to pivot relative to the vehicle body, the pivotal movement being effected by a power means, and a working implement is pivotally mounted on the first boom part, power means acting between the first boom part and the implement, to effect pivotal movement of the implement relative to the first boom part.

12. A boom for a vehicle, the boom comprising first and second parts, the first part carrying means for mounting an earth working implement and the second part having means for mounting the boom on a body of the vehicle, the first and second boom parts being connected together by pivot means which permit relative pivotal movement between the first boom part and the second boom part about a generally horizontal axis, a fluid operated actuating means mounted between the first and second boom parts and being operable to effect the relative pivotal movement between the boom parts in one sense of rotation only to increase an included angle between the first and second boom parts, auxiliary means being provided to effect relative movement between the boom parts to reduce the included angle between the boom parts, the fluid operated actuating means comprising a piston member slidable within a cylinder member, one of the piston and cylinder members being pivotally secured to a mounting point of one of the boom parts and the other of the piston and cylinder members being connected via a linkage to the other boom part, the fluid operated means operating in tension to effect the relative pivotal movement to increase the included angle between the boom parts, the linkage comprising a rigid link element which i pivotally connected to the other of the piston and cylinder members and the linkage extending to and being pivotally secured to a mounting point of the other of the boom parts, the linkage being movable to fold upon a support structure at least in part carried by the other boom part when said included angle is at a minimum, and the rigid link and the pivot connecting the rigid link to the other of the piston and cylinder members being free to move towards and away from the pivot means between the first and second boom parts.

13. A boom according to claim 12 which is more than seven meters long.

14. A boom according to claim 12 in which the rigid element of the linkage is pivotally connected at or adjacent one end to the other of the piston and cylinder members of the fluid operated actuating means, and the rigid element is pivotally connected at or adjacent its other end to a mounting point of the other boom part.

15. A boom according to claim 12 wherein the linkage comprises a second rigid element which is pivotally interconnected at one end to said rigid link element and is pivotally connected at its other end to a mounting point of the other boom part, one of said rigid elements being longer than the other.

16. A boom according to claim 12 wherein the fluid operated actuating means is positioned exteriorly of the boom parts, the mounting points being spaced outwardly of the adjacent regions of the boom parts.

17. A boom according to claim 12 wherein the rigid link element is foldable around the generally horizontal pivot axis between the two boom parts at least as the auxiliary means causes the two boom parts relatively to pivot to reduce the included angle between them beyond a threshold angle.

18. A boom according to claim 12 wherein the support structure comprises a guide means which moves about the generally horizontal pivot axis as the boom parts relatively pivot, the rigid link element engaging the guide means as the boom parts are pivoted beyond the threshold angle.

19. A boom according to claim 13 wherein the geometry of the boom is arranged so that when the second boom part is generally horizontal, the fluid operating actuating means and at least the mounting point of the first boom part are above a generally horizontal plane containing the generally horizontal axis of pivot between the two boom parts.

20. A boom according to claim 12 wherein the auxiliary means comprises a winch and cable arrangement.

21. A vehicle having a vehicle body on which is mounted a boom in accordance with claim 12.

22. A vehicle according to claim 21 wherein the mounting between the second boom part and the vehicle body permits the second boom part to pivot relative to the vehicle body, the pivotal movement being effected by a power means, and a working implement is pivotally mounted on the first boom part, power means acting between the first boom part and the implement, to effect pivotal movement of the implement relative to the first boom part.

* * * * *